US006227875B1

(12) United States Patent
Wu et al.

(10) Patent No.: US 6,227,875 B1
(45) Date of Patent: May 8, 2001

(54) CONNECTOR ASSEMBLY FOR VERTICALLY MOUNTED HARD DISK DRIVE

(75) Inventors: Jerry Wu, Chung-Hua; Chi Sheng Wang; Kelly Shih, both of Tu-Chen, all of (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/472,664

(22) Filed: Dec. 27, 1999

(51) Int. Cl.[7] ..... H01R 12/20
(52) U.S. Cl. ..... 439/79
(58) Field of Search ..... 439/79, 64, 541.5

(56) References Cited

U.S. PATENT DOCUMENTS 5,286,207 * 2/1994 McHugh ..... 439/541.5
5,636,999 * 6/1997 Hirai et al. ..... 439/541.5
5,688,130 * 11/1997 Huang ..... 439/541.5
5,713,747 * 2/1998 Hsia et al. ..... 439/79
5,775,923 * 7/1998 Tomioka ..... 439/79

* cited by examiner

*Primary Examiner*—Gary F. Paumen
(74) *Attorney, Agent, or Firm*—Wei Te Chung

(57) ABSTRACT

A connector assembly includes a pair of connectable first and second connectors for respectively connecting with a disk drive and a PCB in a portable computer casing thereby vertically mounting the disk drive on the PCB and interconnecting the disk drive with the PCB. The first connector defines an upper row and a lower row of first passageways with first terminals retained therein. Each first terminal includes a pair of inwardly inclined first contact arms for mating with a corresponding pin of the disk drive, and a right-angle bent first tail portion retained in recesses of an intermediate plate and downwardly extending therefrom for connecting with the second connector. The second connector defines two rows of second passageways with second terminals retained therein. Each second terminal includes a pair of inwardly inclined second contact arms for mating with the first tail portion of the corresponding first terminal, an abutting arm between the second contact arms for abutting against an inner surface of each of opposite outer side walls of the second housing, and a second tail portion for being inserted into the PCB.

1 Claim, 5 Drawing Sheets

CONNECTOR ASSEMBLY FOR VERTICALLY MOUNTED HARD DISK DRIVE

BACKGROUND OF THE INVENTION

1. Field of the Invention

The present invention relates to a connector assembly, and particularly to a connector assembly for vertically mounting a hard disk drive within a portable computer casing.

2. Description of Prior Art

Most portable computers are equipped with a hard disk drive (HDD) for mass data storage. As portable computers have evolved into more sophisticated computer systems with smaller dimensions and lighter weight, efforts have been directed at providing increasing amounts of data storage with smaller weight and physical dimensions.

In conventional designs, as shown in FIG. 6, an HDD 4 is horizontally inserted into a portable computer 5 through a side opening 52 defined in a casing 51 thereof. To guide the HDD 4 into the casing 51, a pair of guiding rails 53 shown in dashed lines is provided in the casing 51. However, with the space in the portable computer 5 being very valuable, there is little room available for such guiding rails 53. In addition, the insertion or withdrawal of the HDD 4 into or from the side opening 52 will bring static charges to electronic components (not shown) in the computer 5, which are sensitive to the static charges.

Furthermore, to bring a header connector 42 (shown in phantom) at a rear end of the HDD 4 into proper and reliable connection with mating connectors 54 (shown in phantom) in the casing 51, one has to forcibly push the HDD 4 into the side opening 52. This may cause problems. A very important factor to be taken into consideration in engaging the connectors 42 and 54 is that the connectors 42 and 54 have to be in exact alignment with each other. An imperfect alignment, which is usually caused by manufacturing tolerance or undesired deformation or improper insertion of the HDD 4 into the side opening 52, may result in physical damage to the connectors 42 and 54.

The present invention overcomes the above-mentioned problems by providing a connector assembly to vertically mount an HDD on a PCB in a portable computer casing.

SUMMARY OF THE INVENTION

Accordingly, one object of the present invention is to provide a connector assembly including a first connector and a second connector connectable with each other for vertically mounting an HDD on a PCB in a portable computer casing thereby insuring a proper and reliable connection between the HDD and the PCB.

Another object of the present invention is to provide a connector assembly including a first connector and a second connector for vertically mounting an HDD on a PCB in a portable computer casing thereby conserving the occupied area of the PCB.

In order to achieve the objects set forth, a connector assembly of the present invention comprises a pair of first and second connectors for respectively connecting with an HDD and a PCB in a portable computer casing thereby vertically mounting the HDD in the portable computer casing and interconnecting the HDD with the PCB.

The first connector comprises a first housing with an upper row and a lower row of first passageways defined in a front mating surface thereof for receiving a plurality of first terminals. An intermediate plate separates the two rows of first passageways with upper and lower recesses defined in a rear end portion thereof. Each first terminal includes a pair of inwardly inclined first contact arms for mating with a corresponding pin of the HDD, a first retention portion interferentially retained in the first passageway, and a right-angle bent first tail portion for connecting with the second connector. The first tail portions are retained in the recesses of the intermediate plate and downwardly extending therefrom.

The second connector comprises a second housing with two rows of second passageways defined in an upper surface thereof for receiving a plurality of second terminals. Each second terminal includes a pair of inwardly inclined second contact arms for mating with the first tail portion of a corresponding first terminal, an abutting arm between the second contact arms for abutting against an inner surface of each of opposite outside walls of the second housing, a second retention portion interferentially retained in the second passageway, and a downwardly extending second tail portion for being inserted into the PCB.

Other objects, advantages and novel features of the invention will become more apparent from the following detailed description when taken in conjunction with the accompanying drawings.

DETAILED DESCRIPTION OF THE INVENTION

Figure 1:
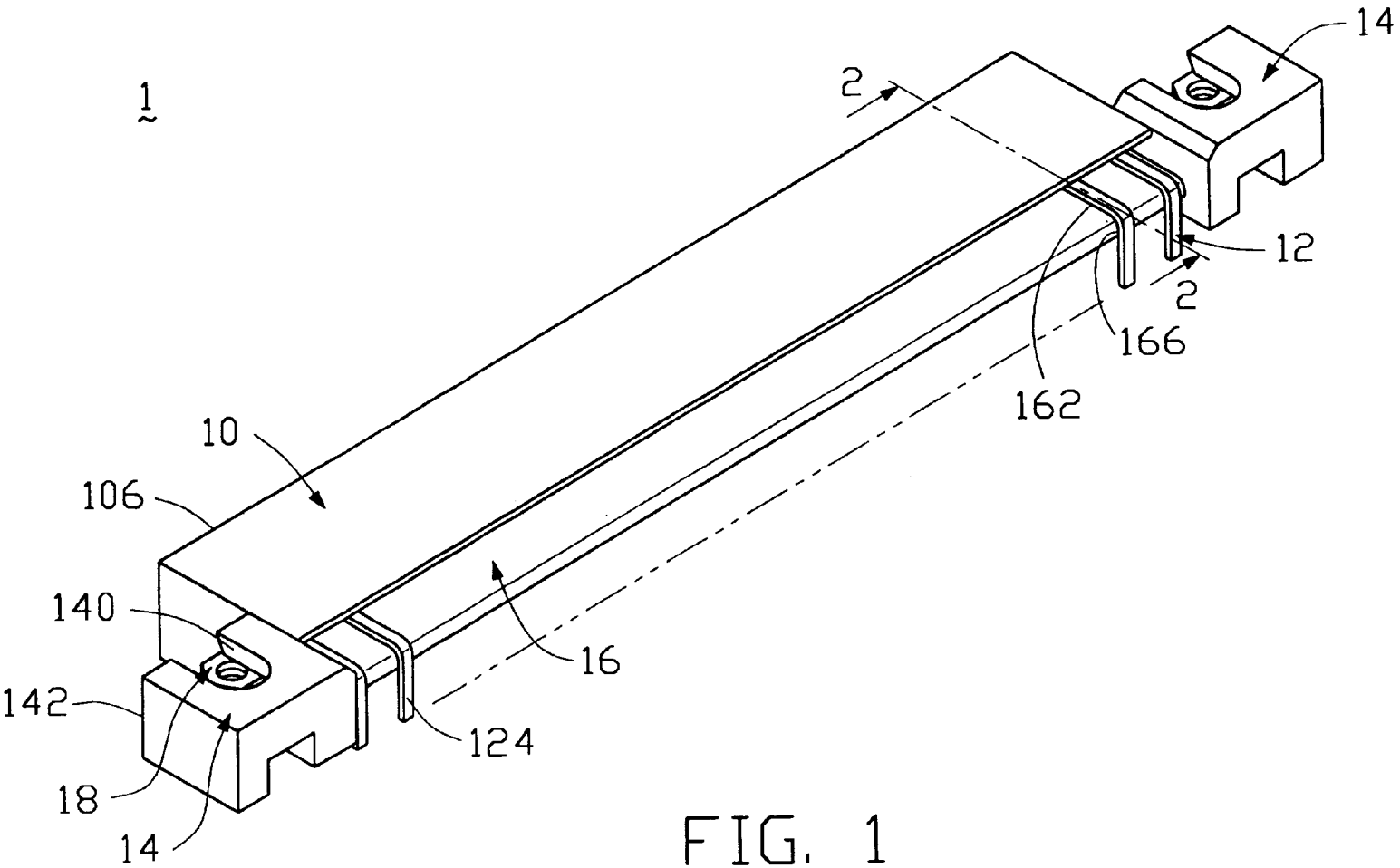
FIG. 1 is a perspective view of a first connector of a connector assembly in accordance with the present invention.

Reference will now be made to the drawing figures to describe the present invention in detail.

Figure 5:
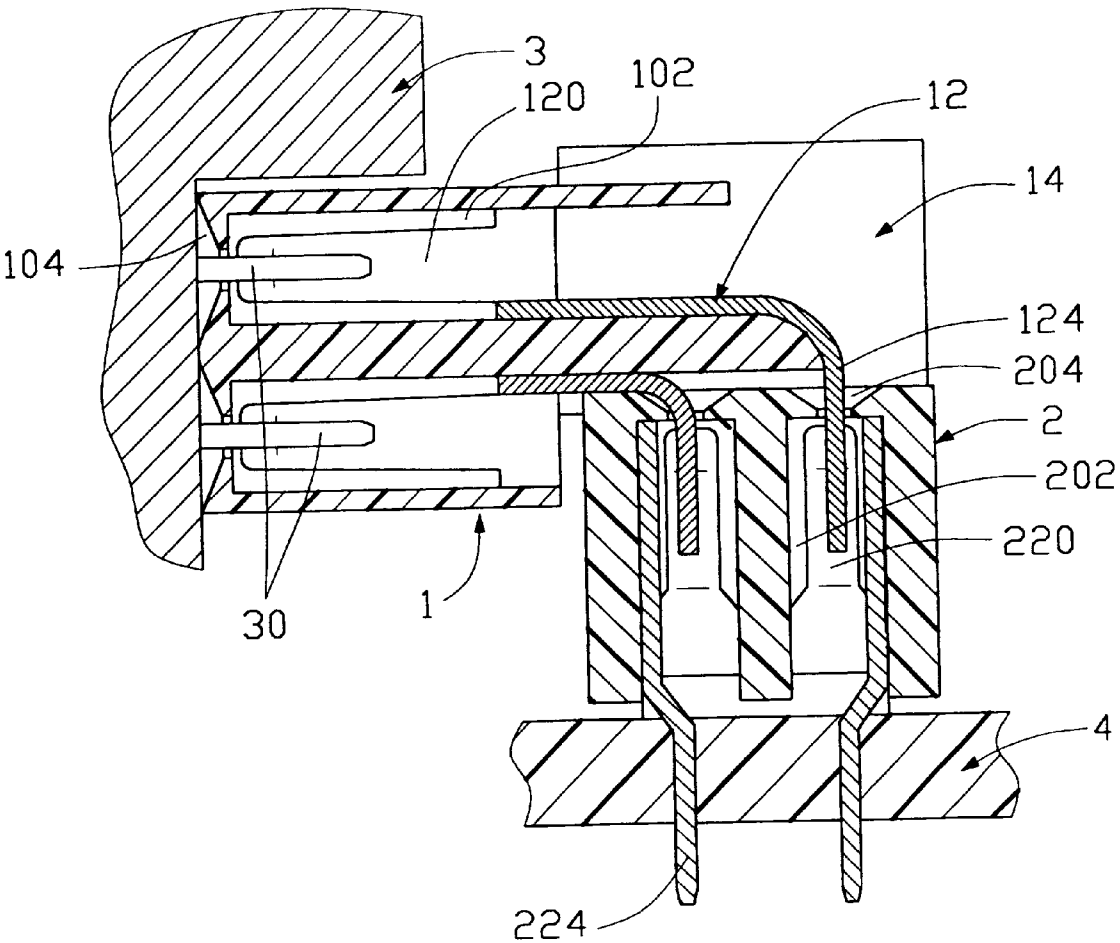
FIG. 5 is a schematic, cross-sectional view showing an HDD being vertically mounted on a PCB by the connector assembly of the present invention.
Figure 6:
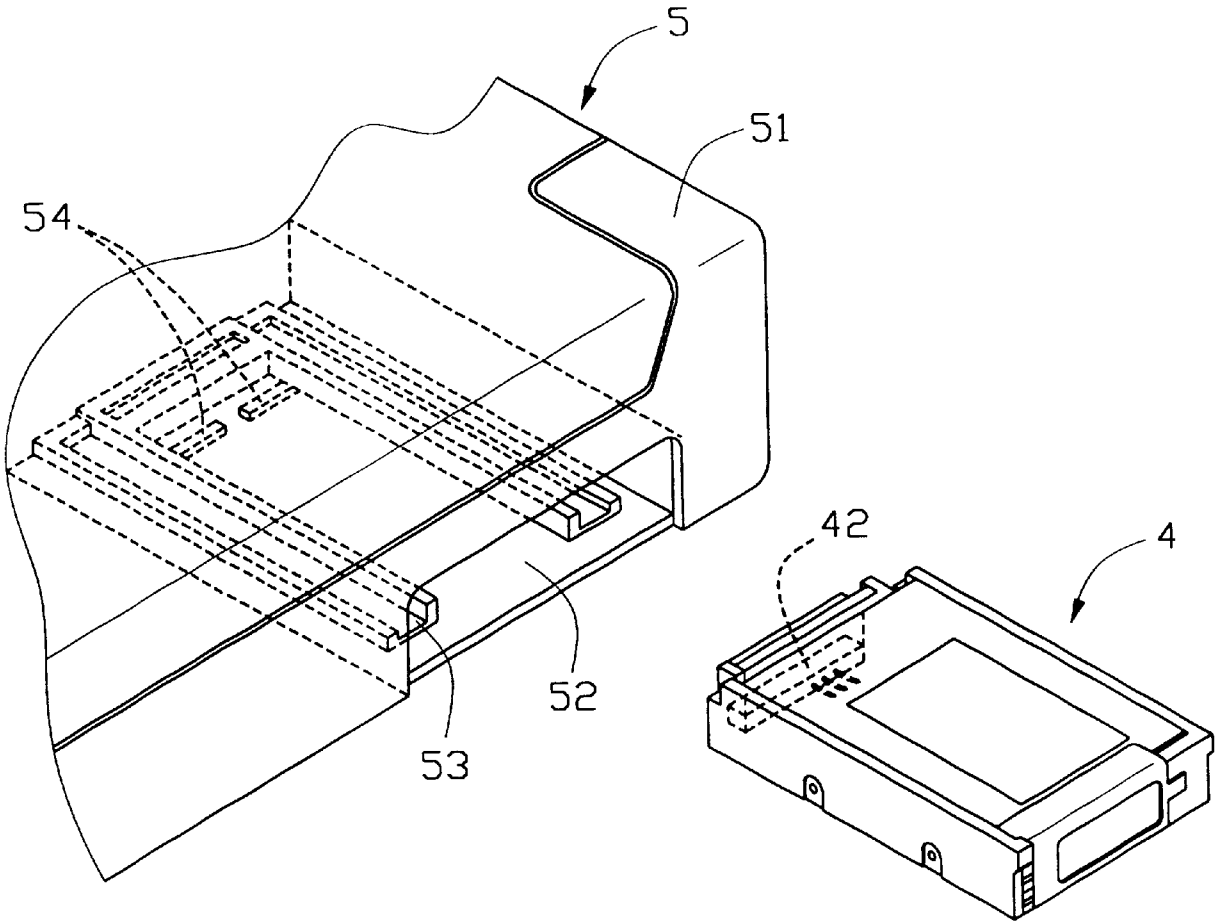
FIG. 6 (PRIOR ART)
FIG. 6 is a schematic, perspective view showing an HDD adapted to be inserted into a portable computer casing in a conventional horizontal direction.

As illustrated in FIG. 5, the present invention provides a connector assembly for vertically mounting an HDD 3 on a PCB 4 in a portable computer casing (not shown). The connector assembly includes a first connector 1 and a second connector 2 connectable with each other. The first connector 1 connects with the HDD 3 and the second connector 2 connects with the PCB 4 thereby interconnecting the HDD 3 with the PCB 4.

Referring to FIG. 1, the first connector 1 of the connector assembly comprises an elongate first dielectric housing 10, a plurality of first terminals 12 retained in the first housing 10, and a pair of retention portions 14 respectively formed on opposite ends of the first housing 10.

Figure 2:
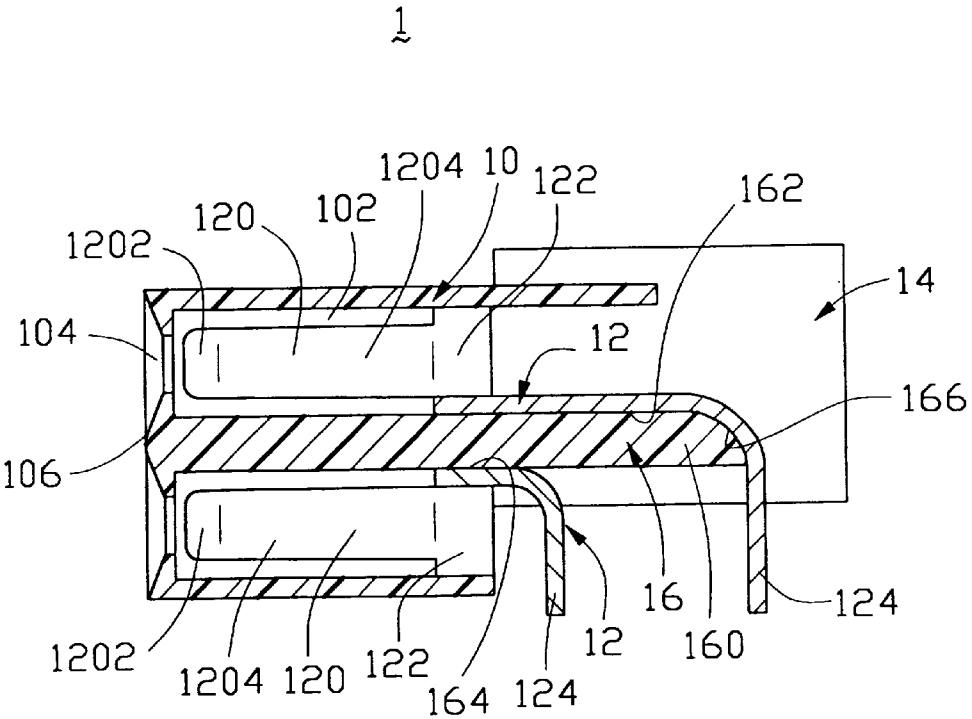
FIG. 2 is a cross-sectional view taken along line 2—2 of FIG. 1.

Also referring to FIG. 2, the first housing 10 defines a plurality of first passageways 102 arranged in an upper row and a lower row for receiving the first terminals 12. A plurality of first mating holes 104 is defined in a front mating surface 106 of the first housing 10 in communication with the corresponding first passageway 102. Each first mating hole 104 has a flared opening for facilitating an extension of a corresponding pin 30 (FIG. 5) of the HDD 3 into the first passageway 102 to connect with a corresponding first terminal 12 retained in the first passageway 102. An intermediate plate 16 separates the upper and lower rows of the first passageways 102. A plurality of upper and lower recesses 162 and 164 are respectively defined in upper and lower surfaces of a rear end portion 160 of the intermediate plate 16 in alignment with the corresponding first passageways 102. Each upper recess 162 has a length longer than each lower recess 164 and extends into a cutout 166 defined in a rear edge of the intermediate plate 16.

Each retention portion 14 defines a cavity 140 open to a front side 142 thereof with a nut 18 interferentially retained therein for extension of a bolt (not shown) therethrough.

As shown in FIG. 2, each first terminal 12 of the first connector 1 includes a first contact portion including a pair of first contact arms 120 (only one is visible), a U-shaped first retention portion 122 interconnecting the two first contact arms 120, and a right-angle bent tail portion 124 integrally formed in a rear of the first retention portion 122 for connecting with the second connector 2. The first retention portion 122 interferentially retains the first terminal 12 in the first passageway 102. The pair of first contact arms 120 of each first terminal 12 includes a pair of first guiding sections 1202 extending away from each other and a pair of first mating sections 1204 extending toward each other. The first guiding sections 1202 guide a corresponding pin 30 of the HDD 3 into the first connector 1 through the first mating hole 104 to electrically engage with the first mating sections 1204. The first tail portion 124 of each first terminal 12 of an upper row is retained in the upper recess 162 of the intermediate plate 16 and then downwardly extends from the cutout 166. The first tail portion 124 of each first terminal 12 of a lower row is retained in the lower recess 160 of the intermediate plate 16 and directly extends downward from the lower recess 160.

Figure 4:
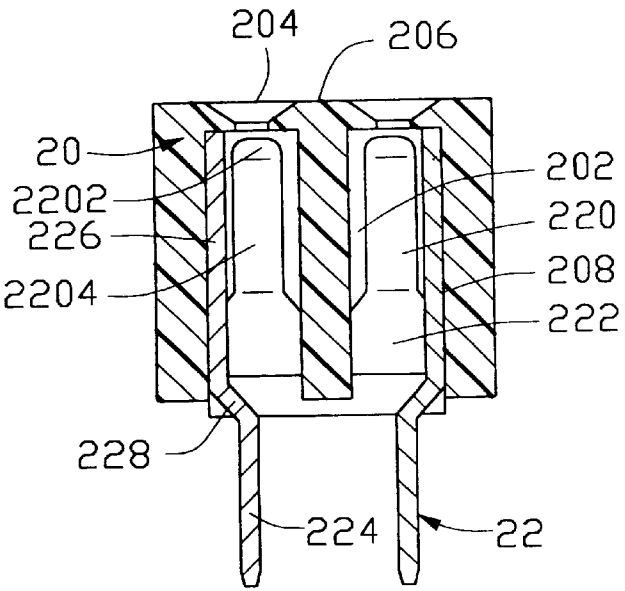
FIG. 4 is a cross-sectional view taken along line 4—4 of FIG. 3.
Figure 3:
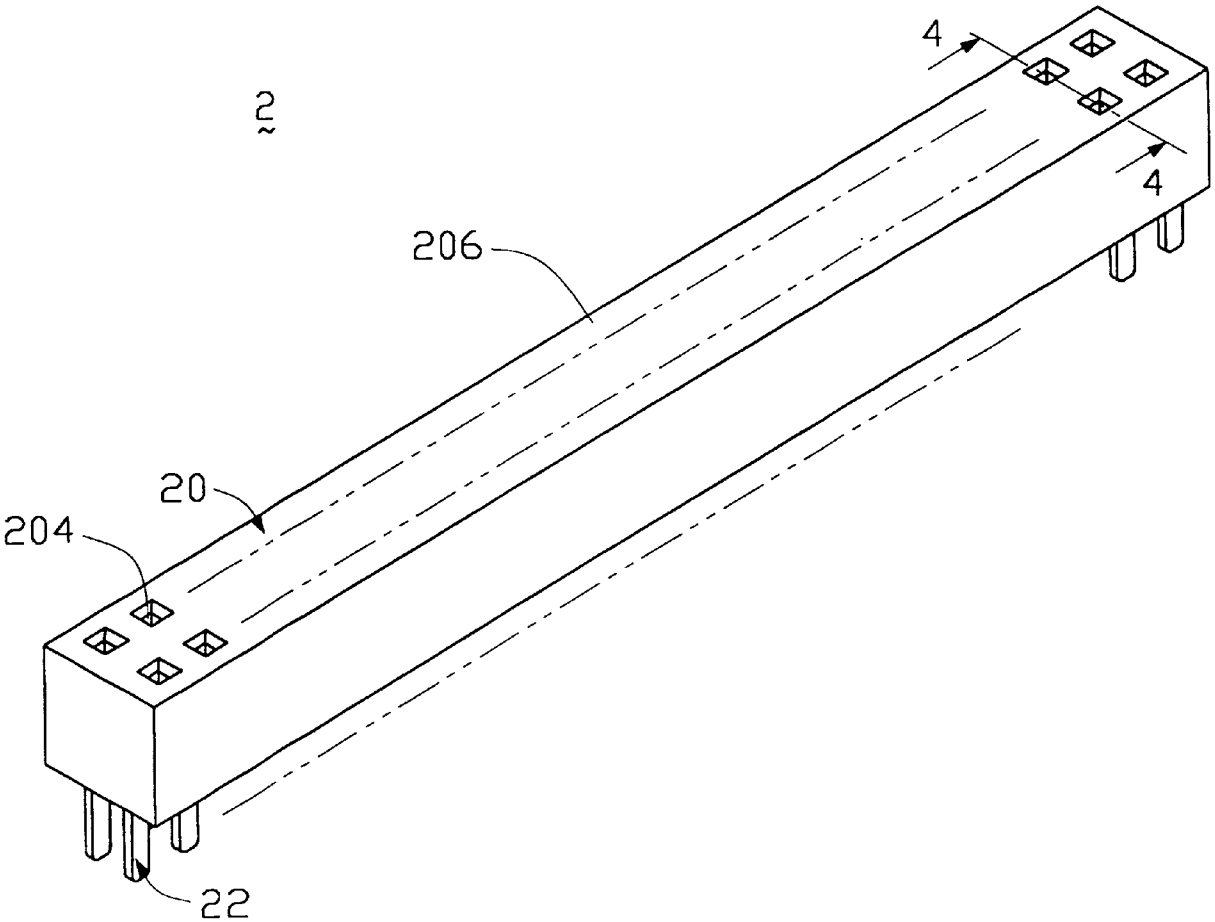
FIG. 3 is a perspective view of a second connector of the connector assembly in accordance with the present invention.

Referring to FIGS. 3 and 4, the second connector 2 of the connector assembly for mating with the first connector 1 comprises an elongate second housing 20 with two rows of second passageways 202 defined therein. A second mating hole 204 having a flared opening is defined in an upper surface 206 of the second housing 20 in communication with the corresponding second passageway 202 for facilitating an extension of the first tail portion 124 of the corresponding first terminal 12 into the second passageway 202.

A plurality of second terminals 22 is retained in the second passageways 202 and downwardly extends from the second housing 20 for being connected to the PCB 4. Each second terminal 22 includes a second contact portion including a pair of second contact arms 220 (only one is visible), an abutting arm 226 between the second contact arms 220 for abutting against an inner surface 208 of each of opposite outside walls of the second housing 20, U-shaped second retention portion 222 connecting the second contact arms 220 and the abutting arm 226, a downwardly extending second tail portion 224 for being connected to the PCB 4, and an inwardly inclined transition portion 228 interconnecting the abutting arm 208 with the second tail portion 224. The second retention portion 222 interferentially retains the second terminal 22 in the second passageway 202. The pair of second contact arms 220 of each second terminal 22 includes a pair of second guiding sections 2202 extending away from each other and a pair of second mating sections 2204 extending toward each other and located below the second guiding sections 2202. The second guiding sections 2202 guide the first tail portion 124 of a corresponding first terminal 12 of the first connector 1 into the second connector 2 to electrically engage the second mating sections 2204. The second tail portion 224 as shown are connected to the PCB 4 by through hole soldering technology. Alternatively, they can be connected to the PCB 4 by surface mounting technology (SMT), as well known by one skilled in the art. For this case, the transition portions 228 are eliminated and the second tail portions 224 are horizontally bent.

Referring to FIG. 5, in assembly, the second connector 2 is first connected to the PCB 4. The pins 30 of an electrical connector (not shown) located in the HDD 3 extend into the corresponding first passageways 102 of the first connector 1 through the first mating holes 104 to connect with the first contact arms 120 of corresponding first terminals 12. Then, the HDD 3 together with the first connector 1 is vertically moved downward into a casing of a portable computer (not shown) to reach a position wherein the first tail portions 124 of the first terminals 12 of the first connector 1 extend into the corresponding second passageways 202 of the second connector 2 through the second mating holes 204 to contact with the second contact arms 220 of the second terminals 22. Bolts are finally brought to extend through the nuts 18 retained in the retention portions 14 of the first connector 1 to fixedly connect with the PCB 4 by a manner known in the art, thereby securely retaining the two connectors 1, 2 on the PCB 4. Thus, the HDD 3 supported in the portable computer casing is connected with the PCB 4 and is vertically mounted in the portable computer casing by the first and the second connectors 1 and 2.

Although the connector assembly of the present invention is disclosed in accordance with a preferred embodiment, it should be understood that the first connector 1 can also be a socket connector and the second connector 2 can also be a pin type header connector. The header connector may have pins upwardly extending therefrom to be inserted into corresponding passageways defined in a bottom surface of the socket connector. The retention portion 14 of the first connector 1 can also be a pair of opposite pegs downwardly extending from the bottom of the first connector 1 to engage with corresponding receiving holes defined in opposite ends of the second connector 2 and to be inserted in the PCB 4.

In such a design of the present invention, a proper and reliable electrical connection between the HDD 3 and the PCB 4 is ensured. Occupied space on the PCB 4 is also conserved since the HDD 3 is vertically mounted on the PCB 4.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. A connector assembly for vertically mounting a disk drive within an electronic device and for interconnecting the disk drive with a printed circuit board within the electronic device, the disk drive having two rows of pins at a rear end thereof, the connector assembly comprising:

a first connector having a first dielectric housing, an upper row and a lower row of first passageways defined in a front mating surface of the first housing, and a plurality of first terminals received in the corresponding first passageways, each first terminal having a first retention portion retained in the first passageway, a first contact portion extending from one end of the first retention portion for connecting with a corresponding pin of a disk drive, and a right-angle bent first tail portion downwardly extending from another end of the first retention portion; and a second connector having a second dielectric housing, two rows of second passageways defined in an upper surface of the second housing, and a plurality of second terminals received in the corresponding second passageways, each second terminal having a second retention portion retained in the second passageway, a second contact portion extending from one end of the second retention portion for connecting with the first tail portion of the corresponding first terminal, and a second tail portion extending from another end of the second retention portion for connecting with a printed circuit board;

wherein the first contact portion of each first terminal includes a pair of first contact arms, each first contact arm including an inwardly inclined first mating section and an outwardly inclined first guiding section, the first guiding sections guiding a corresponding pin of a disk drive into connection with the first mating sections;

wherein the second contact portion of each second terminal includes a pair of second contact arms, each second contact arm including an inwardly inclined second mating section and an outwardly inclined second guiding section, the second guiding sections guiding the first tail portions of the corresponding first terminals into connection with the second mating sections;

wherein each second terminal further includes an abutting arm extending from the second retention portion and between the second mating sections for abutting against an inner surface of the second passageway;

wherein the first housing of the first connector comprises an intermediate plate between the two rows of the first passageways, the intermediate plate having a rear end portion defining upper and lower recesses in upper and lower surfaces thereof and a plurality of cutouts in a rear edge thereof, the recesses being in communication with the corresponding first passageways for retaining the first tail portions of the first terminals, the cutouts being in communication with the corresponding upper recesses for allowing downward extension of the first tail portions of the first terminals in an upper row;

wherein the first housing of the first connector comprises a pair of retention portions respectively formed on opposite ends thereof, each retention portion defining a cavity with a nut interferentially retained therein for extension of a bolt therethrough to engage with a printed circuit board.

* * * * *